United States Patent [19]

Romaine

[11] 4,159,780

[45] Jul. 3, 1979

[54] CHILD-RESISTANT CONTAINER ASSEMBLY

[76] Inventor: Richard A. Romaine, 475 View Crest Dr., Gresham, Oreg. 97030

[21] Appl. No.: 947,351

[22] Filed: Oct. 2, 1978

[51] Int. Cl.[2] ..... B65D 55/02; B65D 85/56

[52] U.S. Cl. ..... 215/215; 215/296

[58] Field of Search ..... 215/210, 207, 214, 215, 215/296

[56] References Cited

U.S. PATENT DOCUMENTS

| | | | |
|---|---|---|---|
| 3,393,815 | 7/1968 | Turecek | 215/215 |
| 3,827,592 | 8/1974 | Deussen | 215/215 |
| 3,841,513 | 10/1974 | O'Connor et al. | 215/215 |

*Primary Examiner*—George T. Hall
*Attorney, Agent, or Firm*—Eugene D. Farley

[57] ABSTRACT

A child-resistant container, e.g. a child-resistant medicine bottle, comprises in combination a container having a neck, a plug or other closure insertable in the neck with the plane of its upper surface extending not substantially beyond the plane of the upper surface of the neck, and rotary interengaging means interengaging the closure and the container neck. A key adapted to overlie the closure has gravity-actuated pin and socket means capable of releasably interengaging the closure and the key. Upon application, the key is operative to engage the closure with the neck and to disengage it therefrom.

7 Claims, 3 Drawing Figures

CHILD-RESISTANT CONTAINER ASSEMBLY

BACKGROUND AND GENERAL STATEMENT OF THE INVENTION

This invention pertains to child-resistant container assemblies. It relates particularly to child-resistant medicine bottles.

With the passage of the Poison Prevention Packaging Act and increased public awareness of the situation to which it relates, it has become of particular importance to provide a practical, commercially acceptable container assembly of this class.

Prior art addressing the situation includes the following: Turecek U.S. Pat. No. 3,393,815; Hall U.S. Pat. No. 3,811,590; Deussen U.S. Pat. No. 3,827,592; Claasen U.S. Pat. No. 3,831,796; O'Connor et al. U.S. Pat. No. 3,841,513; Chahley U.S. Pat. No. 3,912,116;

The devices of the foregoing and other prior art references do not, however, provide a satisfactory solution to the various problems attending the use of such containers.

One such problem resides in the fact that container closures which are child-resistant are also resistant to opening by the elderly, arthritic, and physically impaired who have valid reason for gaining access to the container contents. Old and feeble adults often cannot physically turn a bottle cap past an intended hindrance. Where the containers have a child-resistant cap of small size, the rigid fingers and immobile joints of arthritic or otherwise physically malformed or impaired persons are physically incapable of grasping the cap tightly and applying strength adequate to perform the required action of cap turning, lifting or pressing.

The resultant barrier to gaining access to the bottle contents has produced considerable adult frustration and resultant erratic behavior. Medicine containers are broken intentionally or accidentally when over agressive cap removal is attempted. Medication loss, spillage, or contamination with dirt and glass results. If the effort to open the container is not successful, time delay and missed medical treatments result.

Adults thus frequently elect to transfer medication from child-resistant cap containers to conventionally capped bottles labeled for other drugs. This leads to later confusion. Alternatively, adults have simply left the tops off of the containers.

Other problems which beset the provision of suitable child-resistant containers are the necessity for simple design so that it may be manufactured easily and inexpensively; the necessity of providing a container of simple, unobtrusive design which does not attract attention and offer to the child the challenge of solving a mechanical puzzle; the necessity of providing a moisture-proof closure which seals off the container contents from medicine-degrading atmospheric moisture; and the necessity of providing a closure which does not act upon opening to spill the contents.

Generally stated, the child-resistant container assembly of my invention which overcomes the foregoing and other problems attending the use of the prior art containers comprises a bottle or other container having a neck and a plug or other closure insertable in the neck with its upper surface flush, or slightly below, the plane of the upper surface of the neck.

Threaded or other rotary interengaging means interengage the closure and container neck. A key, preferably having a size too large to be grasped by a child, is adapted to overlie the closure. The key and closure are provided with gravity-actuated pin and socket means which are operative to engage the closure with the neck and disengage it therefrom. Thus in use it is easy for an adult, taking advantage of the leverage offered by the large diameter key, to apply the key and to open the bottle. On the other hand, it is very difficult for a child to do so because he cannot grasp the key effectively and because the key is operative only in the upright position of the bottle.

DESCRIPTION OF PREFERRED EMBODIMENTS OF THE INVENTION

The child-resistant container assembly of my invention is described herein with particular reference to the drawings wherein.

Figure 2:
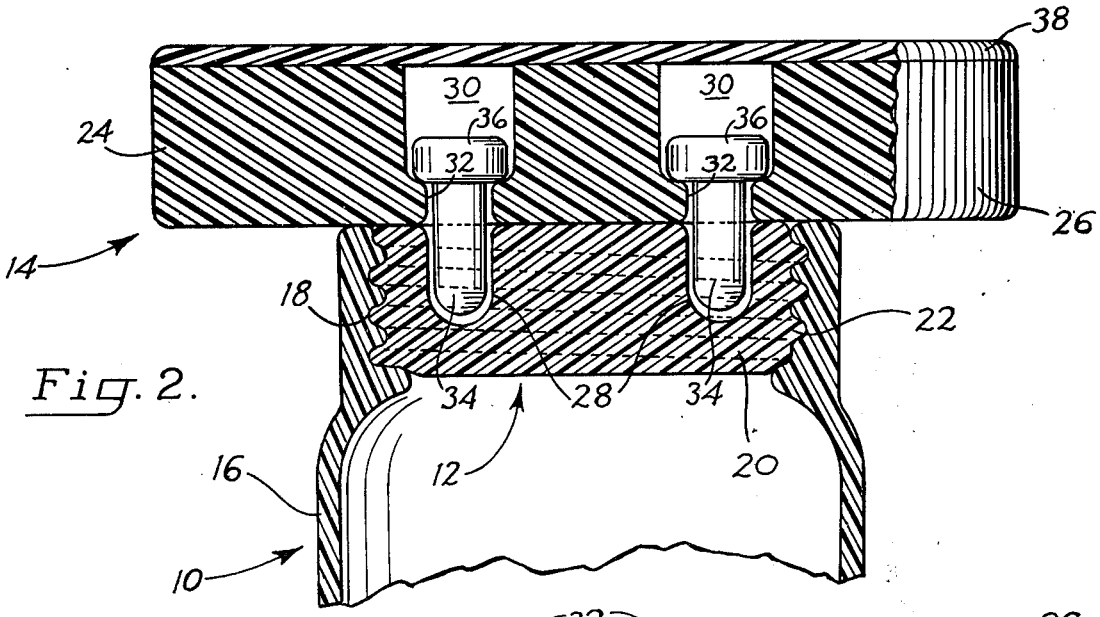
FIG. 2 is a sectional view taken along lines 2–2 of FIG. 1 with the bottle and key component of the assembly in their upright position.

Referring particularly to FIG. 2, the herein described child-resistant container assembly broadly comprises a container indicated generally at 10, a closure therefor indicated generally at 12; and a key for applying and removing the closure, indicated generally at 14.

In its illustrated form the container 10 comprises a bottle made of glass or plastic and suitably dimensioned and contoured for containing the desired medicine in the desired amount. It comprises a body section 16 and an internally threaded neck 18.

Closure 12 preferably comprises a plug 20 having peripheral threads 22 which in the applied position of the closure inter-engage with threads 18 of the bottle neck.

It is to be observed that the upper surface of closure 12 is flat and lies on a plane flush with or below the plane of the bottle neck. This achieves two advantages.

First, it makes it impossible for the child to grasp and unscrew the closure manually, or by picking at it or by biting it.

Second, it presents a plain surface to the exterior. No outstanding mechanical features are displayed which might attract the attention and interest of a child devoted to solving a mechanical puzzle.

Key 14 preferably comprises a disc of plastic or other suitable structural material having a body 24 and periphery 26 knurled for easy grasping.

To achieve the objects of the invention, key 14 has a diameter too large to be grasped by the hand of a child, but suited for grasping by the hand of an adult. A suitable diameter thus lies within the broad range of from 4 to 6 inches, preferably about 4½ inches. The large diameter of the key has the ancillary important function of providing a leverage making possible opening of a difficult closure by even a handicapped person.

Key 14 is adapted to overlie closure 12 and to engage it with and disengage it from the container neck. To this end there are provided gravity-actuated pin and socket means which releasably interengage the closure and the key in the upright position of the container. In the illustrated form of the invention the socket means is provided in the closure and the pin means in the key.

Thus the upper surface of closure 12 is provided with a plurality of recesses 28. Two such recesses are illustrated, although more can be provided if desired.

Key 14 is provided with a matching plurality of transverse bores 30. These have a stepped configuration to provide inwardly extending lips or retainers 32 at their lower ends.

Mounted for free sliding movement within bores 30 are a plurality of pins 34 having heads 36. The pins are of a diameter sufficient for easy reception in sockets 28 of the closure so that the patient can easily insert them in the sockets. Heads 36 of the pins have diameters sufficiently large so that they will not pass retainers 32.

After insertion of the pins in the bores of the key, a cap piece 38 is applied to hold them in place.

OPERATION

The operation of the presently described child-resistant container assembly is as follows:

Container 10 is filled with the desired medicinal material, either liquid or solid.

Closure 12 is screwed into the threaded neck of the container.

Figure 1:
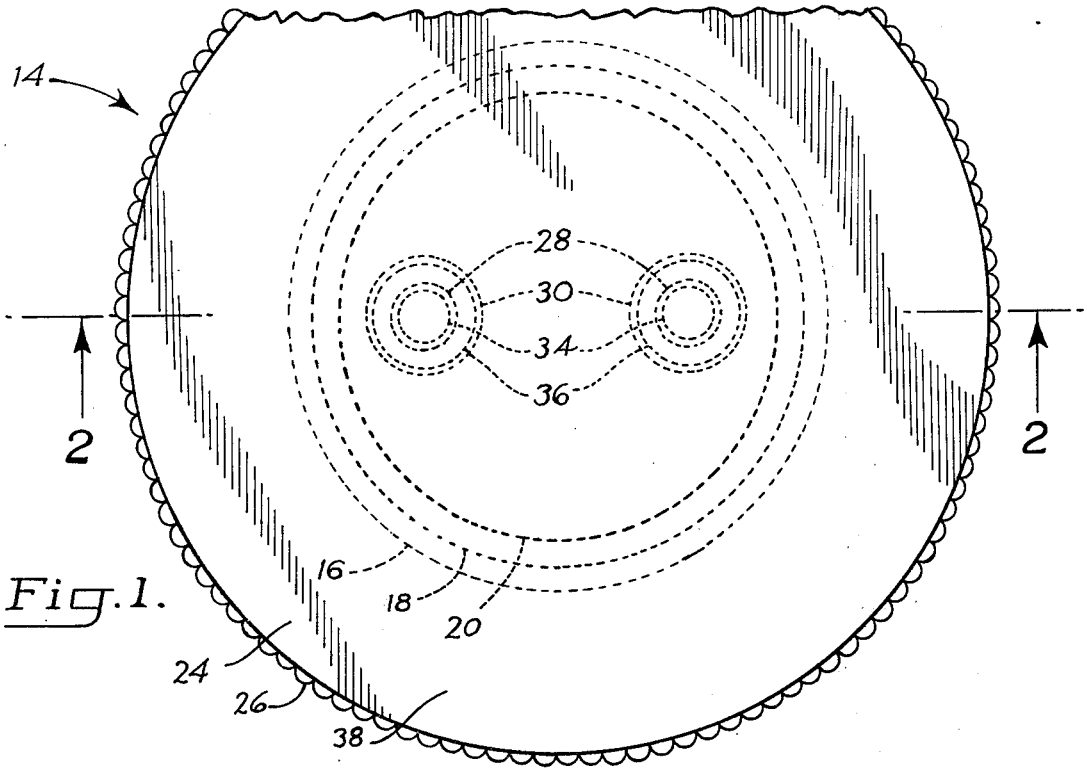
FIG. 1 is a plan view of the assembly.

With the container held upright, and with key 14 in the position of FIG. 1, pins 34 of the key are inserted into recesses 28 of the closure and the key turned to seat the closure with its upper surface flush with the upper surface of the container neck.

Figure 3:
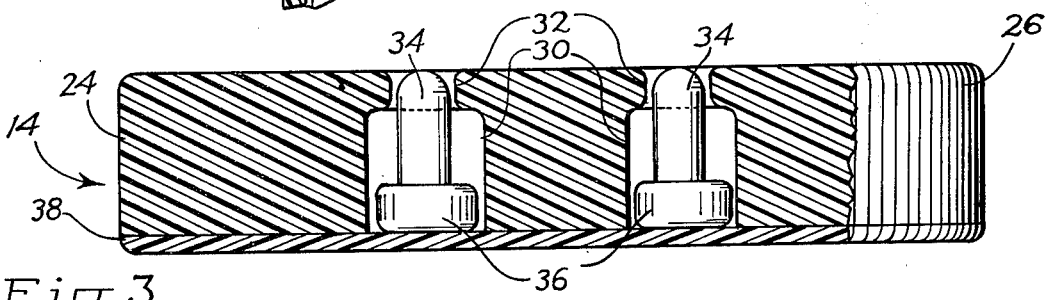
FIG. 3 is a sectional view of the key component of the assembly in inverted position.

When it is desired to open the container, the above procedure is reversed. The unscrewing operation can be carried out easily by an adult. However, if a child attempts to do it, he cannot grasp the key in a manner effective to apply its leverage since it is too big for his hands. If he attempts to solve the problem by turning the assembly upside down and grasping the container, which may be of smaller diameter, the pins gravitationally retract to their FIG. 3 position in which they cannot be inserted into the closure.

Having thus described my invention in preferred embodiments, I claim as new and desire to protect by Letters Patent:

1. A child-resistant container assembly comprising in combination:

(a) a container having a neck, (b) a closure insertable in the neck with the plane of its upper surface extending not substantially beyond the plane of the upper surface of the neck, (c) rotary interengaging means interengaging the closure and the container neck, (d) a key adapted to overlie the closure, and gravity-actuated pin and socket means releasably interengaging the closure and the key, and operative to engage the closure with the neck and to disengage it therefrom.

2. The child-resistant container assembly of claim 1 wherein the rotary interengaging means comprise threaded interengaging means.

3. The child-resistant container assembly of claim 1 wherein the interior of the neck is threaded and the closure comprises a threaded plug.

4. The child-resistant container assembly of claim 1 wherein the key comprises a disc having a diameter too large to be encompassed by the hand of a child but not too large to be encompassed by the hand of an adult.

5. The child-resistant container assembly of claim 1 wherein the gravity-actuated pin and socket means comprise a plurality of pins slidably mounted in recesses in the key and adjustable between retracted and extended positions, and the socket means comprise recesses in the upper surface of the closure receiving the pins in their extended position.

6. The child-resistant container assembly of claim 5 wherein the pins are T-shaped and wherein the recesses in which they are contained are provided with retaining flanges.

7. A child-resistant container assembly comprising in combination:

(a) a container having an internally threaded neck, (b) a plug threadable into the neck with the plane of its upper surface extending not substantially beyond the plane of the upper surface of the neck, (c) a disc-shaped key having a diameter too large to be grasped by the hand of a child but suited for grasping by the hand of an adult, (d) a plurality of recesses in the upper surface of the plug, (e) a matching plurality of gravity-actuated pins slidably mounted in the key and shiftable by gravity between retracted and extended positions, and (f) flanges on the pins and cooperating retainers extending into the recesses for retaining the pins when in their extended positions, (g) the pins being dimensioned for insertion in the recesses when in their extended position and operative to engage the plug with the neck.

* * * * *